US005590504A

United States Patent [19]

Heard et al.

[11] Patent Number: 5,590,504

[45] Date of Patent: Jan. 7, 1997

[54] MOUNTING DEVICES

[75] Inventors: Robert A. H. Heard; Terry Waite, both of Bristol, United Kingdom

[73] Assignee: Signfix Limited, United Kingdom

[21] Appl. No.: 240,745

[22] PCT Filed: Nov. 12, 1992

[86] PCT No.: PCT/GB92/02093

§ 371 Date: Jul. 14, 1994

§ 102(e) Date: Jul. 14, 1994

[87] PCT Pub. No.: WO93/10517

PCT Pub. Date: May 27, 1993

[30] Foreign Application Priority Data

Nov. 12, 1991 [GB] United Kingdom ..... 9123958
May 29, 1992 [GB] United Kingdom ..... 9211385

[51] Int. Cl.[6] ..... G09F 7/18

[52] U.S. Cl. ..... 52/730.1; 52/720.1; 52/736.1; 52/736.2; 40/605; 40/607; 40/624; 248/73; 248/218.4; 248/227.3; 248/230.1; 248/230.9

[58] Field of Search ..... 248/231, 218.4, 248/224.2, 73, 74.3, 74.4, 230.8, 230.9, 231.71, 231.85, 227.3, 227.4, 228.8, 230.1, 230.6, 231.41; 40/605, 607, 624; 52/721, 720.1, 730.1, 731.1, 731.7, 731.8, 733.2, 736.1, 736.2, 737.6

[56] References Cited

U.S. PATENT DOCUMENTS

| | | | |
|---|---|---|---|
| 1,127,596 | 2/1915 | Crabiel | 248/224.2 X |
| 1,483,067 | 2/1924 | Berry | 40/607 X |
| 1,770,564 | 7/1930 | Zahonyi | 40/607 X |
| 1,934,760 | 11/1933 | Awbrey | 52/713 X |
| 2,823,473 | 2/1958 | Jacobs | 40/605 |
| 2,885,808 | 5/1959 | Bastis | 40/624 |
| 3,150,455 | 9/1964 | Indorf | 40/624 |
| 3,266,202 | 8/1966 | Furer | 52/39 |
| 3,330,518 | 7/1967 | Adler | 248/224.2 |
| 3,341,959 | 9/1967 | Sabadics . | |
| 3,634,960 | 1/1972 | Don Carlos | 40/605 |
| 3,650,499 | 3/1972 | Biggane | 248/74.4 X |
| 4,125,240 | 11/1978 | Heard | 248/231 X |
| 4,211,381 | 7/1980 | Heard | 248/231 |
| 4,408,922 | 10/1983 | D'Alessio | 403/400 X |
| 5,175,971 | 1/1993 | McCombs | 52/736.2 |

FOREIGN PATENT DOCUMENTS

| | | | |
|---|---|---|---|
| 10690 | 5/1912 | United Kingdom | 248/73 |
| 1416734 | 12/1975 | United Kingdom . | |
| 1473644 | 5/1977 | United Kingdom . | |
| 1511145 | 5/1978 | United Kingdom | 248/231 |
| 1533412 | 11/1978 | United Kingdom . | |
| 2021390 | 12/1979 | United Kingdom . | |
| 2039119 | 7/1980 | United Kingdom | 40/605 |
| 2128215 | 4/1984 | United Kingdom | 52/721 |
| 2229846 | 10/1990 | United Kingdom . | |
| 2254950 | 10/1992 | United Kingdom | 40/605 |
| 85/05716 | 12/1985 | WIPO | 40/607 |

OTHER PUBLICATIONS

Balls et al., "Quick–Attachable Hook–Shaped Cable Bracket", Oct. 1973, Western Electric Technical Digest No. 32, pp. 7–8.

*Primary Examiner*—Wynn E. Wood
*Assistant Examiner*—Laura A. Saladino
*Attorney, Agent, or Firm*—Larson and Taylor

[57] ABSTRACT

A sign is formed from a plurality of panels abutted edge-to-edge. A main elongate reinforcing member has a transverse head for attachment thereto of a mounting device for the sign, and a depending leg terminating in an offset foot secured to the rear of a first sign panel adjacent an abutting edge of the panel. A second, elongate, reinforcing member has a generally L-shaped cross-section including a foot portion secured to the rear of an adjacent second sign panel at the edge abutting the first panel and an upright portion abutting the leg of the main reinforcing member. One of the reinforcing members has a flange at the foot projecting into a recess in the foot portion of the other reinforcing member. The head of the reinforcing member is offset with respect to the leg on the opposite side from the projection of the foot to expose the foot for rivetting to the plate.

6 Claims, 8 Drawing Sheets

MOUNTING DEVICES

FIELD OF THE INVENTION

This invention relates to mounting devices suitable for the mounting of signs to supporting posts, although the mounting devices in one or more aspects of the invention could be used in other mounting situations.

BACKGROUND OF THE INVENTION

In a series of earlier patents, for example GB 1416734, GB 1533412 and GB 2021390, I disclosed mounting devices suitable for securing a post to a reinforcing channel on the rear of a sign panel, the channel mouth being furnished with inturned lips to retain elements of the mounting device. The mounting devices were typically pressed from stainless steel sheet, and the reinforcing channels were normally made from extruded aluminium. The system has proved extremely successful for many years; however I have now conceived of a modification or departure from that successful design concept which appears in practice to be surprisingly advantageous, particularly providing a construction of considerable strength and durability while economising substantially in the materials and costs involved.

Another aspect of the invention deals with the problem of forming larger signs from two or more panels abutted edge to edge. Conventionally some kind of construction or device is provided to prevent light from passing through a gap between adjacent panels, it being virtually impossible to provide a light-tight joint between the panels by simple abutment. Such devices or constructions which are used in practice tend to be expensive, complicated, unreliable or in other ways unsatisfactory. I have conceived of a construction which provides distinct advantages over some of the available alternatives. This aspect of the invention can employ the improved mounting device referred to in the preceding paragraph, to make use of the advantages provided thereby.

SUMMARY OF THE INVENTION

According to one aspect of the present invention there is provided an elongate reinforcing member for a sign panel, having in cross-section a foot portion for securing to the rear face of a sign panel and a head portion having a dove-tailed slot for engagement with a trapezoidal shaped head at the end of a strap for passing around a supporting post.

Preferably said trapezoidal shaped head at one end at least of the strap is cut in the flat sheet material of the strap. A said trapezoidal shaped head may be provided by the chamfered head of a bolt, the threaded shank of which extends through an aperture in an out-turned flange at the end of the strap and is tightenably retained by a nut.

The head of the reinforcing member is preferably connected to the foot by a leg, and preferably the head and leg together have a generally T-section.

According to another aspect of the invention there is provided an elongate reinforcing member for a sign panel, having in cross-section a foot-portion for securing to the rear face of a sign panel a head portion for attachment to a strap for passing around a supporting post, and a leg connecting the head and foot, the head being offset with respect to the leg so that the foot projects in the opposite direction for rivetting to a sign panel.

According to a further aspect of the invention there is provided a sign formed from a plurality of panels abutted edge-to-edge, a main elongate reinforcing member having in cross-section a transverse head for attachment thereto of a mounting device for the sign, and a depending leg terminating in an offset foot secured to the rear of a first said sign panel adjacent an abutting edge of said panel, and an elongate co-operating member having a generally L-shaped cross-section comprising a foot portion secured to the rear of an adjacent second said sign panel at the edge abutting the first panel and an upright portion abutting the leg of the main reinforcing member, one of the reinforcing members having a flange at the foot projecting into a recess in the foot portion of the other reinforcing member.

The top of the upright portion of the co-operating reinforcing member is preferably offset to engage under the head of the main reinforcing member. Said flange is suitably provided at the foot of the main reinforcing member and the recess is provided in the foot of the co-operating reinforcing member.

The main reinforcing member of the sign panel as described above may be a reinforcing member as described in the first aspect of the invention.

BRIEF DESCRIPTION OF THE DRAWINGS

In order that the invention may be more clearly understood, various embodiments thereof will be described by way of example with reference to the accompanying drawings, wherein.

DESCRIPTION OF THE PREFERRED EMBODIMENTS

Figure 1:
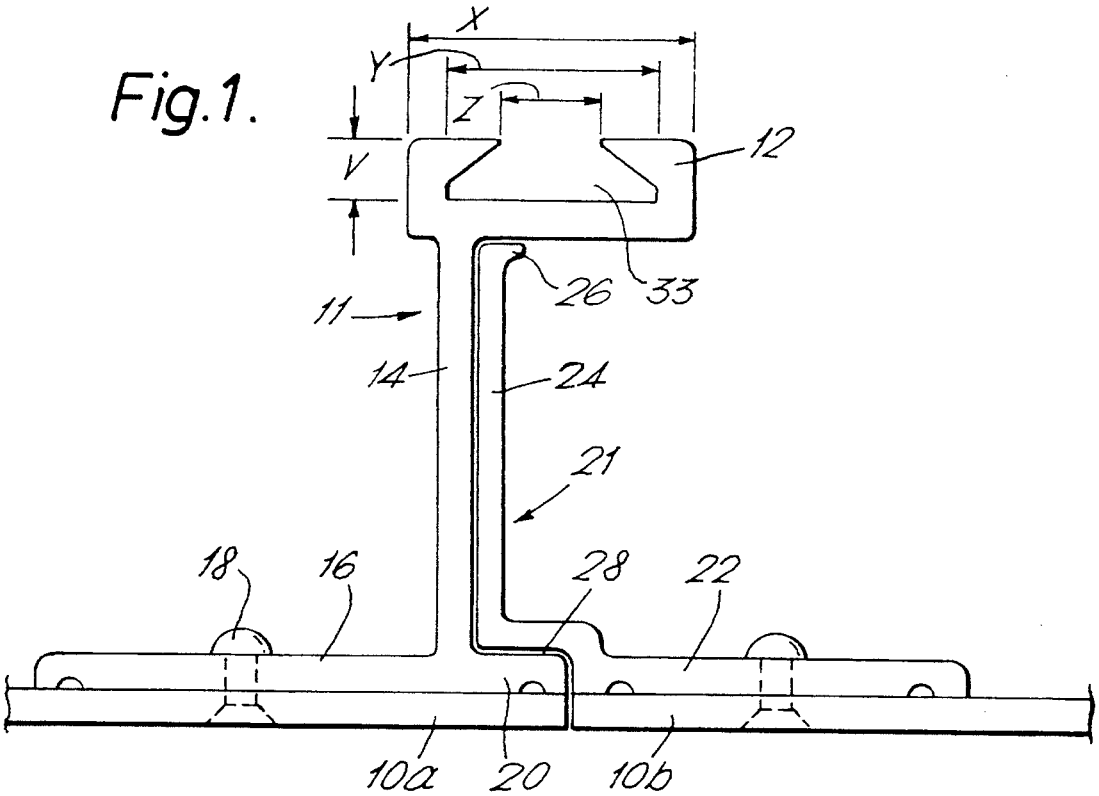
FIG. 1 shows an end view of a joint between two panels in a sign employing a mounting device of the present invention.

Referring to the drawings, and firstly to FIG. 1, a sign is formed from a plurality of sign panels 10*a*, 10*b*, abutting edge-to-edge. Secured to the rear face of one of the panels 10*a* is an elongate main reinforcing member 11 of extruded aluminium, comprising a T-shaped head portion 12 from which depends a leg 14 leading to a foot 16. The foot 16 is secured to the rear face of the sign plate suitably by rivets 18, although it could instead or in addition be by means of adhesive. The head 12 and foot 16 are offset in opposite directions with respect to the leg 14, thereby exposing the foot for access by a rivetting device. This is important in allowing the rivets to be applied from the rear of the sign, which enables the other ends of the rivets to be flush with the front face of the sign. The head 12 is shown offset in that it projects more to one side of the leg than the other, but it could project wholly to one side of the leg, if appropriate.

The foot 16 is likewise shown in this embodiment as only partially offset with respect to the leg, thereby providing a coplanar flange 20 projecting in the opposite direction. The reinforcing member 11 is secured to the panel 10*a* so that the flange 20 lies flush with the edge of the panel which abuts the panel 10*b*.

A co-operating reinforcing member 21, also of extruded aluminium is secured to the rear face of the panel 10*b*. It is of L-shape in cross-section and comprises a foot 22 which is secured to the panel 10*b* by rivets and/or adhesive, and an upright portion 24 with a turned-over lip 26. The foot 22 is provided with a rebate 28 suitable to accommodate the flange 20 of the main reinforcing member 11. The foot 22 of the co-operating reinforcing member 21 is secured to the panel 10*b* so that the rebate 28 projects beyond the edge of the panel abutting the panel 10*a*. In this condition the upright portion abuts the leg 14 of the main reinforcing member with the lip 26 engaging under the head 12. The abutting portions 14,24 can be secured together, for example by rivets bolts or clamps. In an alternative arrangement, the flange 20 could be provided on the co-operating reinforcement member 21 and the rebate 28 in the main reinforcement member 11.

The head 12 of the main reinforcing member is provided with a dove-tailed channel 33 running the length of the head. Its dimensions are suitably as indicated in FIG. 1 where V=5 mm, X=20 mm, Y=16.2 mm and Z=8.2 mm.

Figure 2:
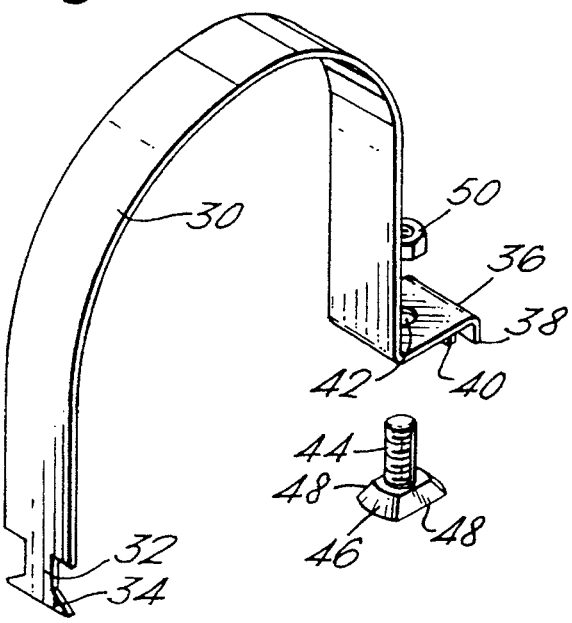
FIG. 2 shows a perspective view of an attachment device and strap for securing the sign to a supporting post.
Figure 3:
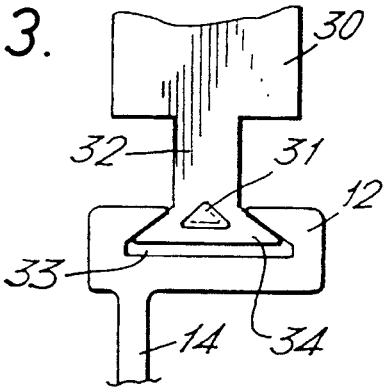
FIG. 3 shows an end view of the head of the main reinforcing member of FIG. 1 with the flat end of the attachment device of FIG. 2.
Figure 4:
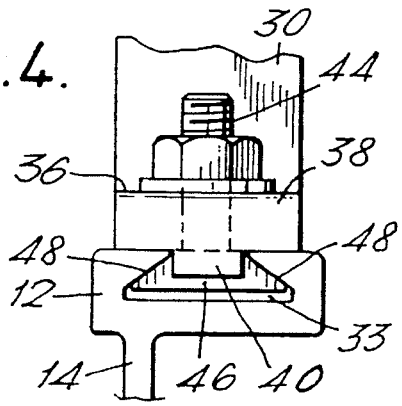
FIG. 4 shows an end view of the head of the main reinforcing member of FIG. 1 with the other end of the attachment device of FIG. 2 engaged.

In this channel are engageable the end attachments of a mounting device such as that shown in FIG. 2. The mounting device comprises a U-shaped strap 30 formed from stainless steel sheet, having at one end portion a narrowed neck 32 terminating in a trapezoidal end 34 whose sloping shoulders, e.g. at an angle of 37° to the horizontal, match the sloping internal sides of the dove-tail channel, so that the end 34 can be inserted through the channel mouth in the lengthwise orientation and then twisted into the transverse orientation as shown in FIG. 3, where it is retained by the channel. A blip or swage 31, suitably of triangular form, is preferably pressed in the sheet material of the trapezoidal end 34 to increase its rigidity.

At the other end the strap 30 is formed with an out-turned flange 36, terminating in a down-turned lip 38 with a central nib 40. The flange 36 has an aperture 42 to receive the shank of a bolt 44 whose head 46 is provided with chamfered sides 48 to match the sloping internal sides of the channel 33 so that it can be retained therein. Thus, the head of the bolt can be introduced into the end of the channel 33 and slid along it to the desired position with the shank projecting from the channel mouth to allow the flange 36 to be fitted to it and retained by a nut 50 which also serves to tighten the strap around a post to which the sign is to be mounted.

The mounting device illustrated in FIG. 2 in conjunction with the dove-tail slotted head of the aluminium reinforcing member proves to be of quite surprising strength. For example, with dimensions similar to those indicated, and a bolt head of 13.2×13.2 mm a load of 1,291 kg was required to pull the head of the bolt through the mouth of the channel. Even more surprisingly, at the other end, the flat stainless steel end of the strap, despite having a sheet steel thickness of only 1.8 mm, did not pull through the much softer aluminium until a force of 808 kg was applied.

Figure 5:
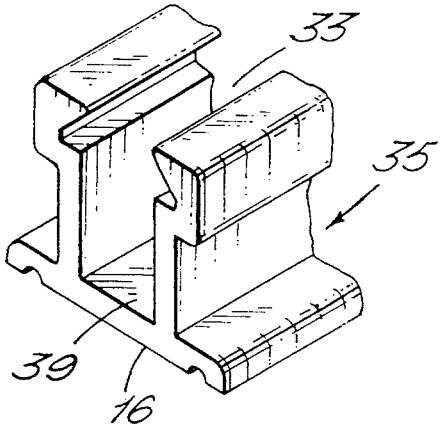
FIGS. 5 and 6 show perspective views of reinforcing members suitable for smaller signs.
Figure 6:
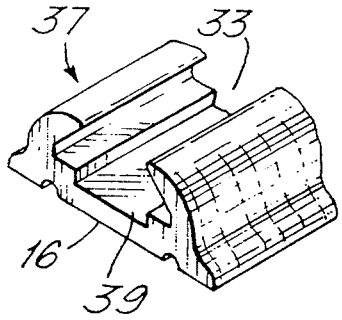

FIGS. 5 and 6 show smaller elongate reinforcing members 35, 37 for attachment to small sign panels. Each reinforcing member has a dove-tailed slot 33, the floor 39 of which coincides with the foot 16 for attachment to the sign panel, for example by rivetting.

Figure 7:
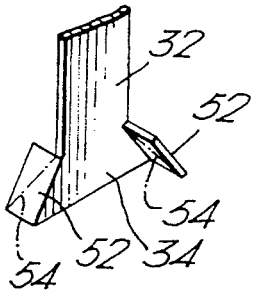
FIG. 7 shows a perspective view of a modification of the flat end of the attachment device of FIG. 2.

Referring to FIG. 7, a modification of the trapezoidal end 34 has ears 52 extending in opposite directions to increase the area of engagement with the sloping internal sides of the channel 33. The ears may be rectangular as shown or triangular as indicated at 54.

Figure 8:
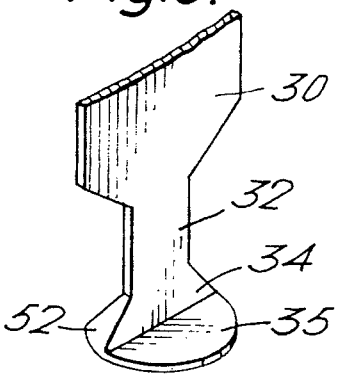
FIGS. 8 and 9 show respectively a perspective view, and a side view of another modification of the flat end of the attachment device of FIG. 2.
Figure 9:
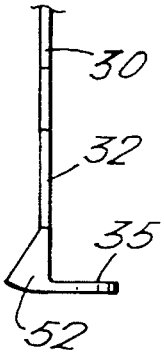

In a further modification, as shown in FIGS. 8 and 9, the ears 52 may extend in the same direction, and an optional lip 35 of generally semi-circular outline may extend in the opposite direction.

The method of forming a reinforced joint as shown in FIG. 1 is simple, effective and more economical than most conventional arrangements. Moreover, the interengaging flange 20 and recess 28 prevent a light-transmitting gap from forming between adjacent panels.

More generally, the reinforcing member which employs a T- or I-section as represented by the head 12, leg 14 and foot 16, provides a saving of about 30% in material over the equivalent strength reinforcing channel of my earlier designs which have been successfully used for many years, as noted earlier.

This aspect of the invention has led me to conceive of alternative forms of attachment of a mounting strap to the head of a T- or I- section reinforcing member, as exemplified below.

Figure 10:
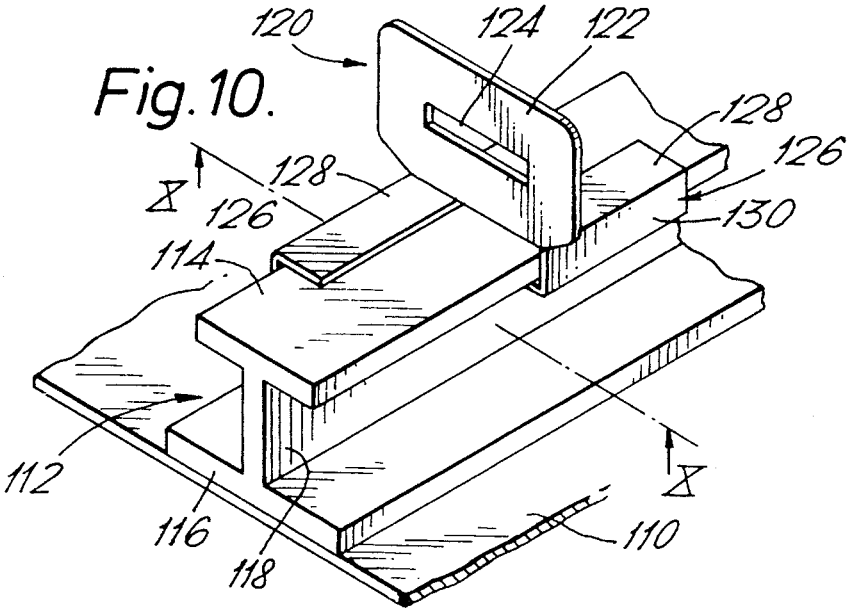
FIG. 10 shows a perspective view of a first embodiment of attachment member for external attachment of a mounting device on T-shaped head of a reinforcing member.
Figure 11:
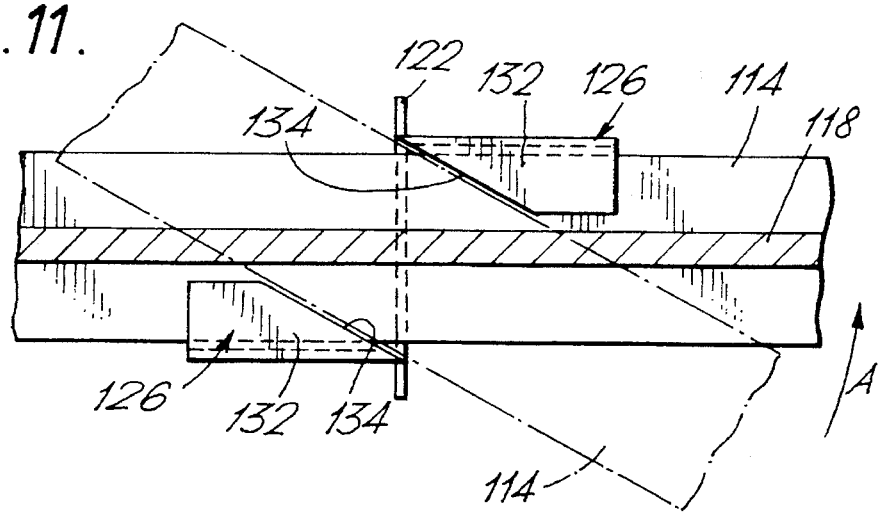
FIG. 11 shows a cross-section on the line X—X of FIG. 10, indicating the manner in which the attachment member is fitted to the reinforcing member.

Referring to FIGS. 10 and 11; a sign panel 110 has secured to its rear surface one or more elongate reinforcing members 112, suitably made from extruded aluminium. The reinforcing member is of generally I-section, having a head 114 and foot 116 joined by an intermediate web 118. The foot 116 is secured to the rear surface of the sign panel 110, for example by rivets or adhesive in known manner.

An attachment member 120 is connected to the head 114, and is suitably pressed from stainless steel sheet. It comprises a generally rectangular body part 122 with a transverse slot 124 to receive in known manner a strap for passing around a post to which the sign is to be mounted. Projecting from opposite sides of the body 122, the attachment member is provided with a pair of limbs 126 of mutually inwardly opening channel section, having a top wall 128, a side wall 130 and a bottom wall 132 (see FIG. 11). The spacing between the top and bottom walls 128, 132 is sufficient to slidably accommodate the head 114 of the reinforcing member 112, while the least distance between the two walls 130 is a little greater than the width of the head 114. In addition, as shown in FIG. 11, the walls 132 have mutually facing truncated edges 134, also spaced apart by slightly more than the width of head 114.

As shown in FIG. 11, the attachment member 120 can be fitted on the reinforcing member 112 by introducing the head 114 between the truncated edges 134 of the limbs 126, as indicated in phantom lines. Thereafter, the attachment member and reinforcing member are mutually swivelled, as shown by the arrow A, bringing them into the secure position shown in full lines, in which the head 114 is located within the channels of the limbs 126, thereby retaining the attachment member on the reinforcing member. The attachment member can be released from the reinforcing member by reversing the process.

Figure 12:
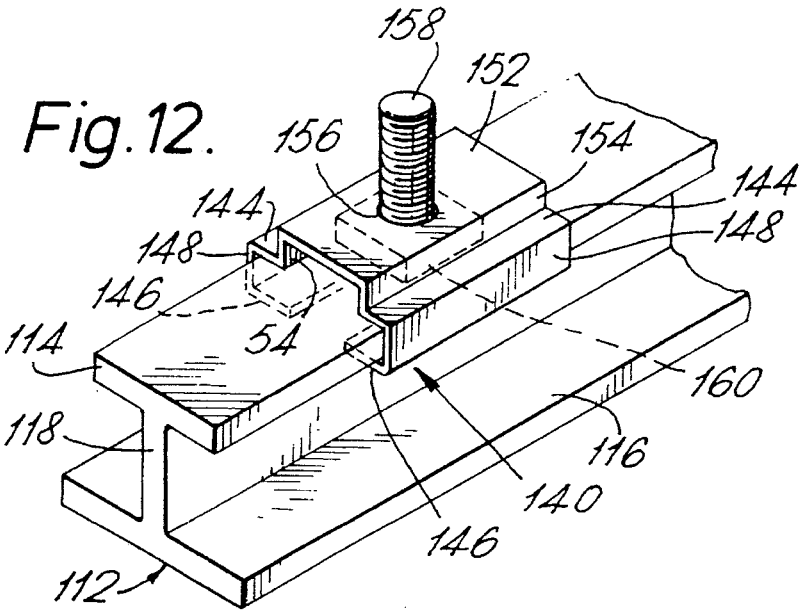
FIG. 12 shows a perspective view, of a second embodiment of external attachment member.

Referring now to FIG. 12; an attachment member 140, also suitably formed from stainless steel sheet, comprises a pair of mutually inwardly directed side channels having top and bottom walls 144, 146 joined by a side wall 148. The top walls 144 are joined by an inverted channel bridge portion comprising a top wall 152 and side walls 154. As with the limbs 126 in the attachment member of FIG. 10, the side channels are of a size and configuration suitable to slidably receive and be retained on the head 114 of the T-shape reinforcing member 112. The top wall of the bridge portion 152 has a central aperture 156 through which projects the shank 158 of a bolt, whose head 160 is retained within the channel of the bridge piece, the side walls 154 being of a sufficient height to accommodate the head, and the distance between the side walls 154 being only slightly greater than the width of the, preferably rectangular, head 160, whereby the head is prevented from rotating within the channel of the bridge piece.

The attachment member 140 can be fitted onto the head 114 of the reinforcing member by sliding it lengthwise along the head. Alternatively, the side walls 148 and bottom walls 146 can be configured similarly to the side walls 130 and bottom walls 132 of the attachment member shown in FIGS. 10 and 11, so that the attachment member 140 can be fitted onto the head 114 in the same manner as shown in FIG. 11.

Figure 13:
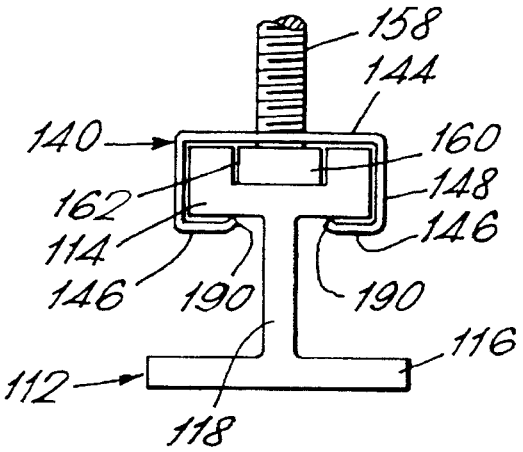
FIG. 13 shows an end view of a third embodiment of external attachment member, being a modification of that shown in FIG. 12 for use with a modified section of reinforcing member.

Referring to FIG. 13; the head 114 in this case is thicker than that shown in the earlier embodiments, but has a central recess 162 extending the full length of the extrusion, and of a width sufficient to accommodate the head 160 of the bolt, but prevent it from rotating. In this case, the attachment member 140 is similar to that shown in FIG. 12, except that it does not need to have a channel shape bridging piece. Instead the two channels are simply bridged by having a common top wall 144, centrally apertured to receive the shank 158 of the bolt.

Figure 14:
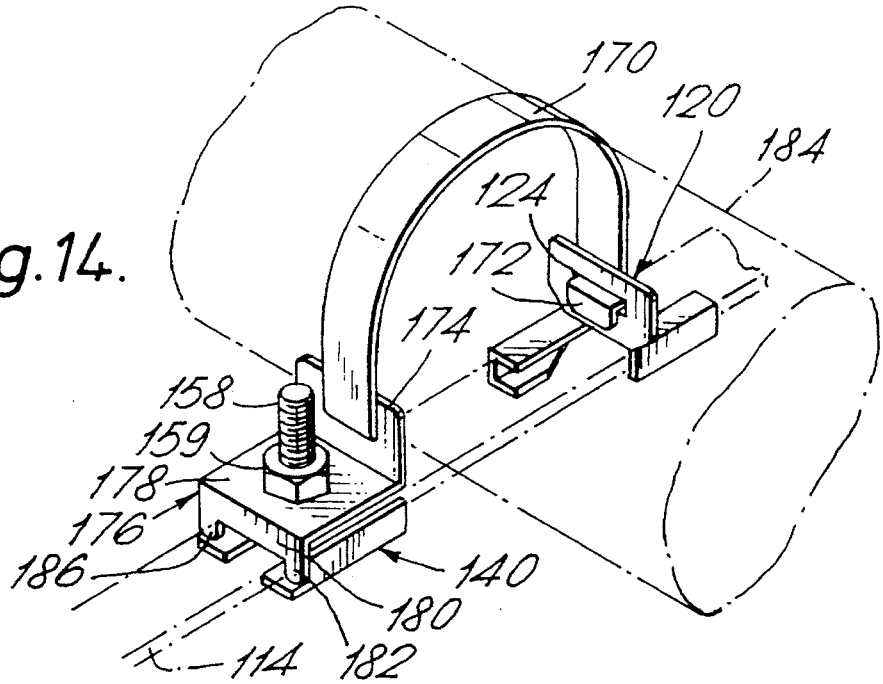
FIG. 14 shows a perspective view of a complete mounting device incorporating the attachment members of FIGS. 10–12.

Referring to FIG. 14; with a reinforcing member as shown in FIGS. 10–12 (only the head is shown), a complete mounting device is constructed from an attachment member 120 as illustrated in FIGS. 10 and 11, an attachment member 140 as illustrated in FIG. 12, a U-shaped strap 170 cranked at one end 172 for insertion into the slot 124 in the attachment member 120, and the other end of the strap being similarly cranked for engagement in a slot in one limb 174 of a chair-shaped bracket 176. The seat portion 178 of the chair shape bracket has a central aperture to fit over the shank 158 of the bolt projecting from the attachment member 140, where it is retained by a nut 159. The depending portion 180 of the chair-shaped bracket has a pair of outer legs 182 which fit either side of the head 114 of the reinforcing member.

In use, the attachment member 140 is fitted on the head 114, and likewise the attachment member 120, with the strap 170 passed around a post 184 and the chair-shaped member 176 fitted onto the shank 158 of the bolt of the attachment member 140. The nut 159 is then applied and screwed down to tighten the strap around the post.

As a refinement of the attachment member 140, as more particularly illustrated in FIG. 13, the lower walls 146 of the mutually facing side channels of the attachment member can be provided with inturned swages 190 which bite into the under-surface of the head 114 of the reinforcing member when the strap is tightened around the post, thereby resisting any tendency of the attachment member to slide along the reinforcing member. Additionally or alternatively, such swaging can be provided on the lower walls 132 of the attachment member 120.

Figure 15:
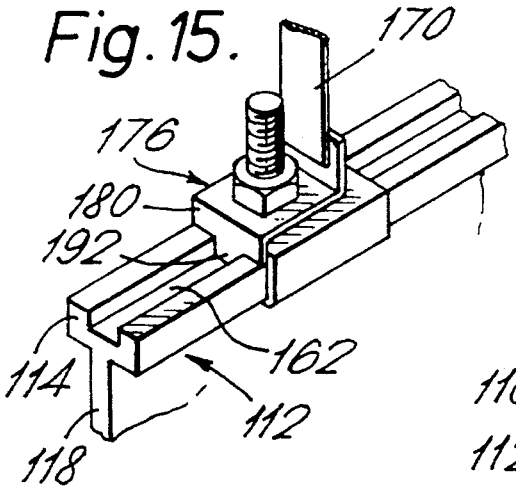
FIG. 15 shows part of the mounting device of FIG. 14, modified to suit the modified reinforcing member as shown in FIG. 13.

As shown in FIG. 15, where the reinforcing member 112 has the modified form shown in FIG. 13, the depending portion 180 of the chair-shaped bracket 176 can have a single central leg 192 to enter the channel 162, instead of the pair of legs 182 to lie outside the head 114.

Figure 16:
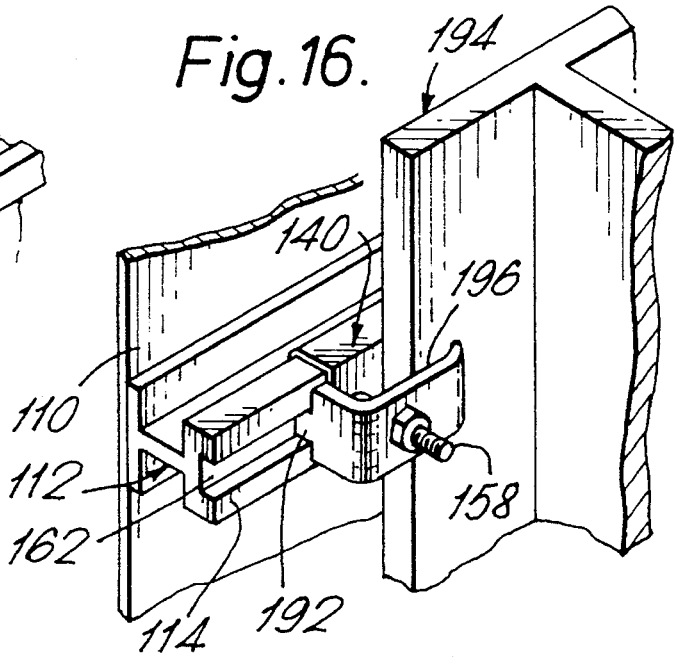
FIG. 16 shows a perspective view of the modified reinforcing bar and attachment member of FIG. 13 in conjunction with a supporting post of T- or I-section.

Referring to FIG. 16; where the fixing is to be to a T- or I-section post 194, it may be inconvenient to provide a strap 170 shaped and of sufficient size to pass around the post; and instead, a pair of attachment members 140 can be used, with the bolts therefrom each securing an L-shaped finger element 196, which in known manner clamps the edge of a flange of the post 194. The clamping finger 196 can be provided at one end with a leg 192, similar to that shown in FIG. 15, where the reinforcing member 112 has the modified form shown in FIGS. 13 and 15. Otherwise this may be omitted, or a pair of outer legs provided similar to the legs 182 shown in FIG. 14.

Figure 17:
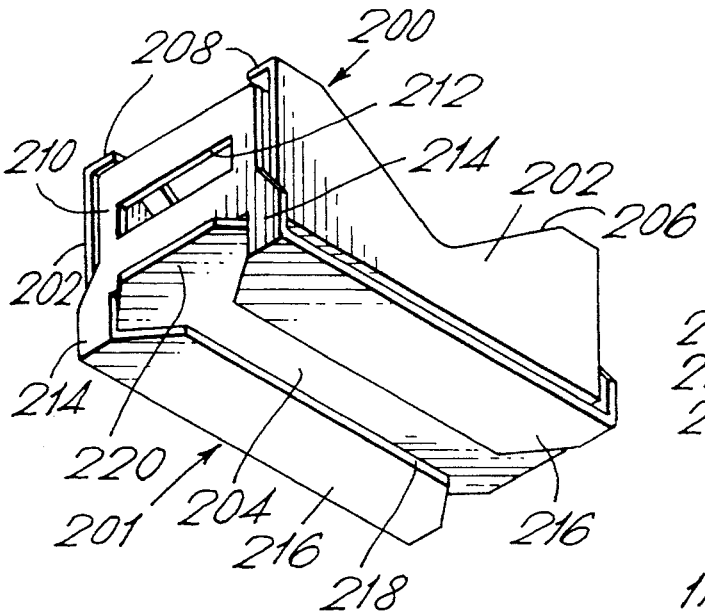
FIG. 17 shows a perspective view of a saddle-form mounting device of the present invention.
Figure 18:
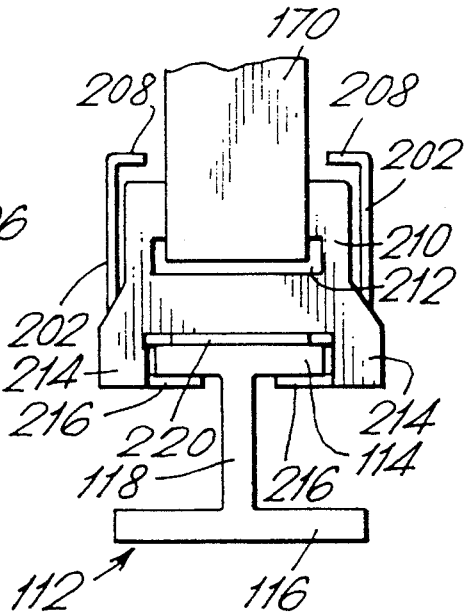
FIG. 18 shows an end view of the device of FIG. 17 in use.

Turning now to FIG. 17; this is a modification of the saddle-shaped mounting device disclosed in my patent specification GB 1533412. The device comprises two parts, each formed from stainless steel sheet. A first part 200 is of generally channel form, having a pair of side walls 202 joined by a base 204. The free edges of the side walls 202 have shallow V-profiles 206 to bear upon circular mounting posts of varying diameters, and these edges of the side walls 202 may be turned over, as at 208, to provide increased bearing surfaces and minimize damage to the post. The other part 201 of the device is a U-shaped bracket having a pair of similarly shaped opposite end plates 210, each having a slot 212 for attachment to a strap 170 (see FIG. 18), the plate having a pair of depending limb portions 214 which are joined to corresponding limbs of the opposite end plate by respective strips 216. The two strips 216 are separated by a gap 218 a little wider than the thickness of the wall 118 of the reinforcing member 112, while the distance between the depending limbs 214 of the end plates 210 is slightly greater than the width of the head 114 of the reinforcing member, and the length of the limbs 214 is sufficient to allow the head 114 to be accommodated between the base 204 of the component 200 and the strips 216 of the component 201, as shown in FIG. 18. The base 204 of the channel component is extended at each end to form a pair of tongues 220 to project between the limbs 214 of the other component, and thereby hold the two components together when not in use.

In use, the mounting member is slid lengthwise onto the head 114 of the reinforcing member, and a strap 170 passed through the slots 212 and around the post, and tightened and secured, suitably by a buckle or nut and bolt in known manner. This tightening has the effect of drawing the strips 216 upwards towards the base 204, thereby securely clamping the head 114 of the reinforcing member between them.

Figure 19:
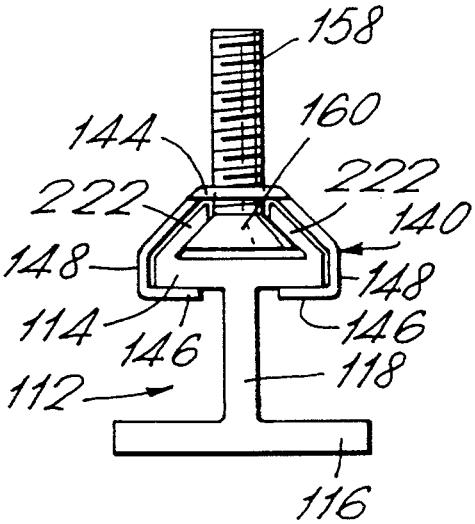
FIGS. 19 and 20 show similar end views of attachment members modified from those of FIGS. 12 and 13, for use with further modified cross-sections of reinforcing member.
Figure 20:
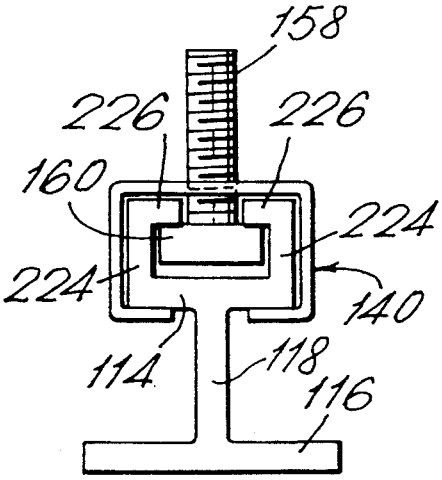

Referring now to FIGS. 19 and 20; here the heads 114 of the reinforcing members 112 are extended upwardly to form an upwardly opening channel. In the case of FIG. 19, the upper extensions take the form of mutually inwardly inclined walls 222, around which slidably fits an attachment member 140 of similar cross-section. The head 160 of the bolt is trapped within the channel and has a trapezoidal cross-section to match the internal shape of the channel. On tightening the strap around the post, the head is drawn upwardly to wedge in the mouth of the channel, while the embracing attachment member 140 prevents the channel mouth from opening under the strain.

The embodiment shown in FIG. 20 is essentially similar, except that in this case the channel formation on the head 114 has a rectangular configuration, with side walls 224 topped by mutually inturned lips 226, the resulting channel accommodating non-rotatably the rectangular head 160 of the bolt.

Figure 21:
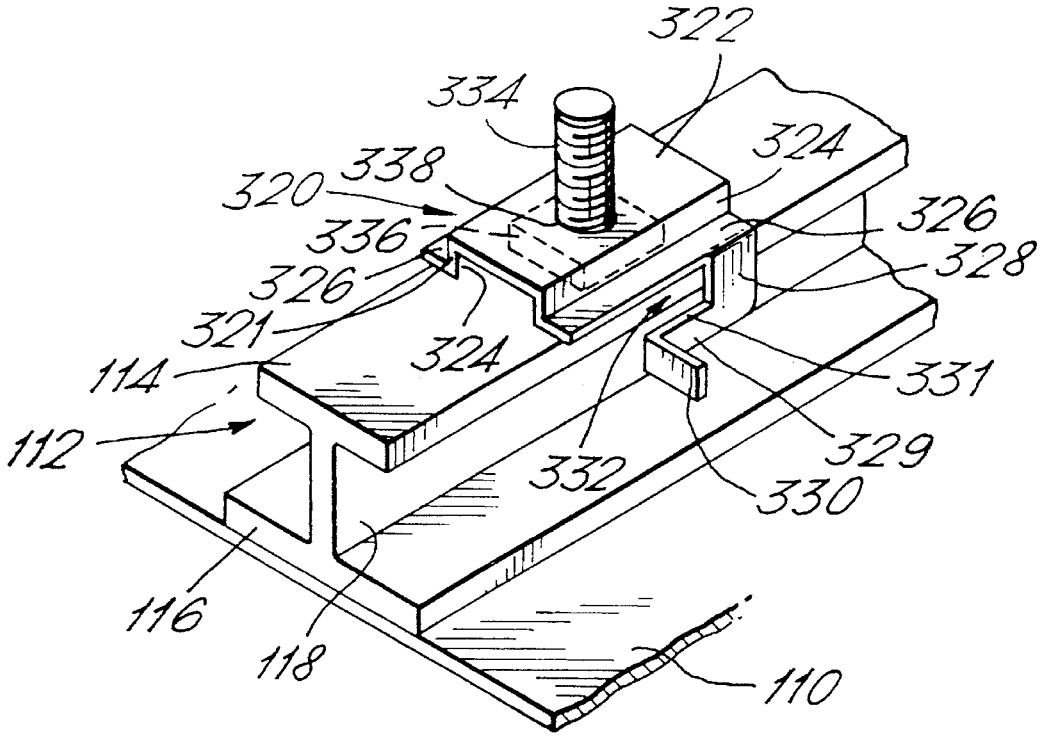
FIG. 21 shows a perspective view of a further embodiment of external attachment device positioned on a reinforcing member in the non-secured position.

Referring to FIG. 21; an attachment device 320, which is suitably pressed from stainless steel sheet, is shown located on the first head 114 in an unsecured position. The attachment device comprises a body plate 321 in the form of an inverted channel bridge portion comprising a top wall 322 and side walls 324. On either side of the bridge portion 322 and connected to the side walls 324 are further top walls 326. Connected to these top walls 326 and at opposing corners of the body plate are L-shaped side walls 328, the free-limbs 329 of the L terminating in wings 330.

When the attachment device is in the unsecured position as shown in FIG. 21, the wings 330 are directed mutually outwardly from the reinforcing member 112. A space 332 is defined by the body plate 321 and the edge of free limb 329 to enable the attachment device 320 when in a desired position on reinforcing member 112 to be twisted (in a clockwise direction in the embodiment shown, where a normally threaded bolt 334 is used) such that the spaces 332 receive the head 114, and the free-limbs 329 of the side walls 328 engage under the head of T. In use, the sign would be connected to a post by a strap passed around the post and fitted onto the shank 334 of the bolt. In this manner, the tightening of the nut also serves to fasten the attachment device 320 to the strap. The other end of the strap may be likewise connected to a further attachment member 320, or any other suitable attachment device, for example as described herein.

Figure 22:
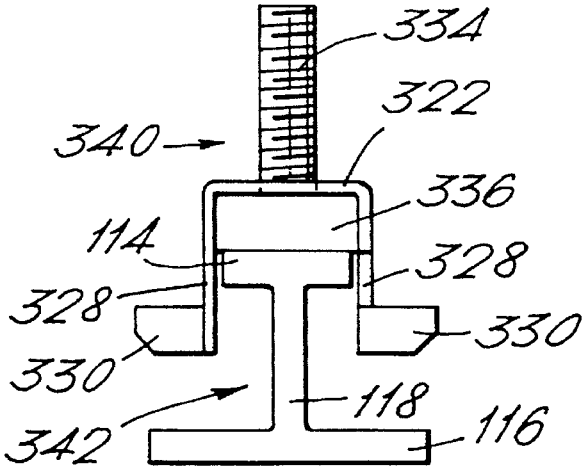
FIG. 22 shows an end view of another embodiment of external attachment device, shown in the non-secured position on a reinforcing member.

The attachment device 320 shown in FIG. 21 is suitable for retaining quite large signs etc. via reinforcing members 112. With less substantial signs, it is possible to use a reinforcing member of smaller cross-section, as illustrated in FIG. 22, where the body plate of the attachment device 340 is reduced in size accordingly. The attachment device 340 is for the most part essentially similar to the device 320 shown in FIG. 21 the step formed by side wall 324 and top wall 326 having been omitted, and the L-shaped side walls 328 depending directly from the bridge portion 322.

Figure 23:
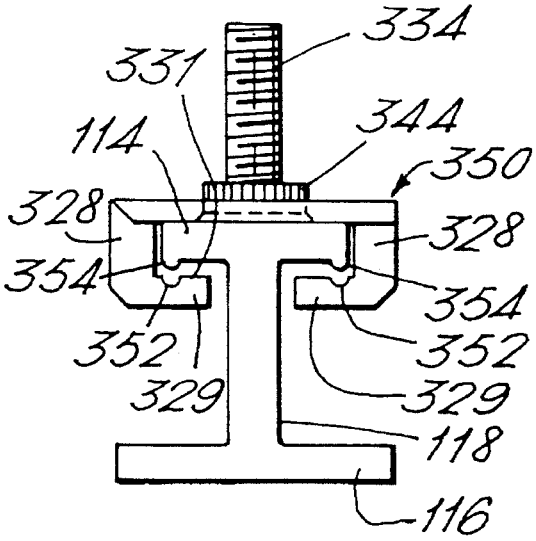
FIG. 23 shows an end view of yet another embodiment of external attachment device, shown in the secured position on a reinforcing member.

FIG. 23 shows another embodiment of attachment member in which the head of the bolt has been replaced by a stud 344 of known type, having a knurled periphery which prevents its rotation after it has been pressed into an aperture in the plate. Also shown in FIG. 23, on the edge 331 of the free limbs 329 are notches 352. On tightening attachment member 350, notches 352 receive projections 354 on the underside of the head 114, thereby further increasing the firmness of the attachment. It is also feasible for the notches to be provided on the underside of the cross-piece 314 and to provide the free limbs 329 with the corresponding projections.

Figure 24:
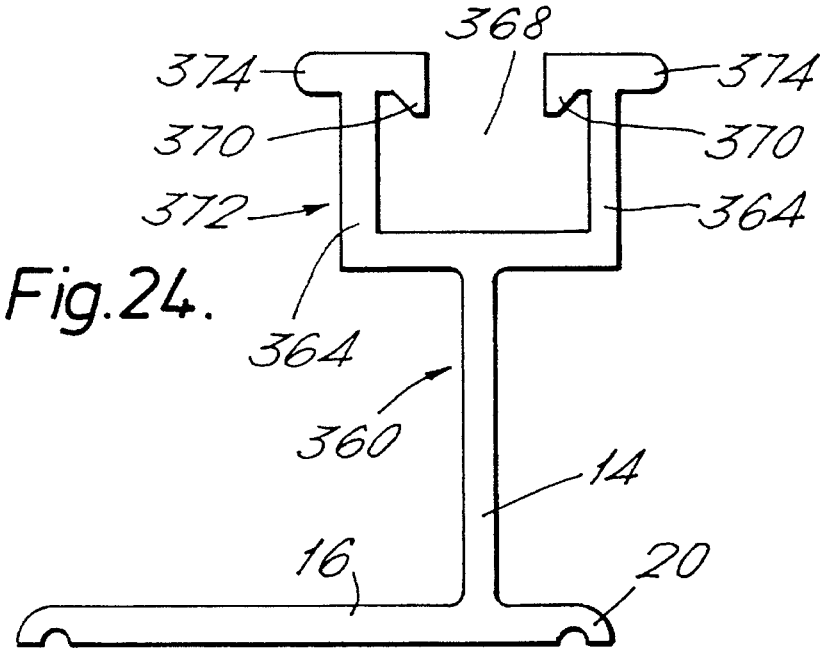
FIG. 24 is an end view of a multi-functional reinforcing member, provided with a channel with inturned lips.

Although reinforcement members of T-section show some distinct advantages over existing channel-type reinforcing members, the success of the system based on reinforcing channels ensures that attachment members for use with that earlier system will continue to be manufactured and in general use for a considerable time. Accordingly, there will be a need for a means of using the earlier, channel-fitting attachment members with the T-section members disclosed herein. The reinforcing member 360 shown in FIG. 24 is a multi-function type, based on the main reinforcing member of FIG. 1, that can accept attachment members of the channel system as well as those for T-sections. Instead of a head 12 as shown in FIG. 1, a head region 372 surmounts the leg 14 of the T. A channel 368 is provided in the head 372 defined by walls 364, and opening upwardly away from leg 14 of the T and has lips 370 directed inwardly, and preferably also downwardly, with respect to channel 368. In one functional mode, the channel 368 can be used for connection with attachment devices for channel section members, the inturned lips 370 retaining elements of such a device. In another functional mode, the outside of the head region 372 can be used for connection with attachment devices for T-section members such as those disclosed earlier. In this functional mode, the side channels of the attachment devices fit slidably and securably around projections 374 which constitute the extremities of the head of the T.

Multi-function members of the general type shown in FIG. 24, may, of course, support a head region 372 with a channel 368 of any of the types known in the art.

Figure 25:
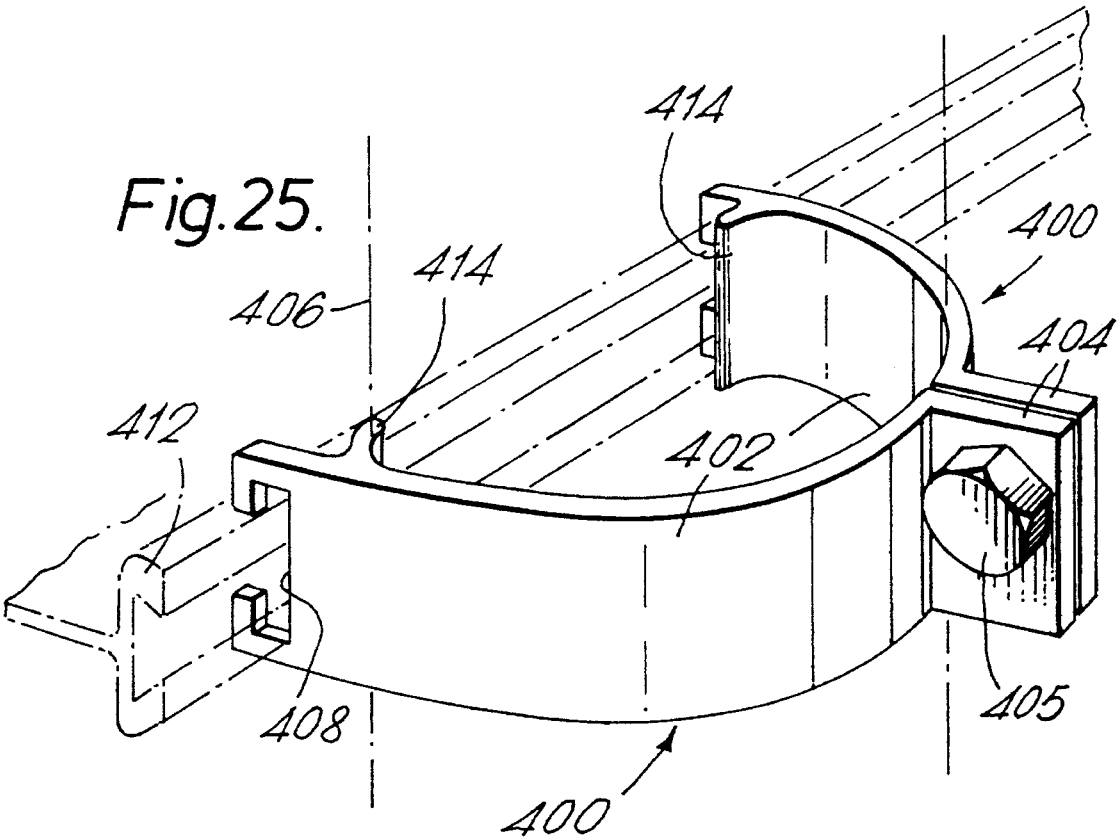
FIG. 25 shows a perspective view of a further embodiment of mounting device for a T-shaped reinforcing member.
Figure 26:
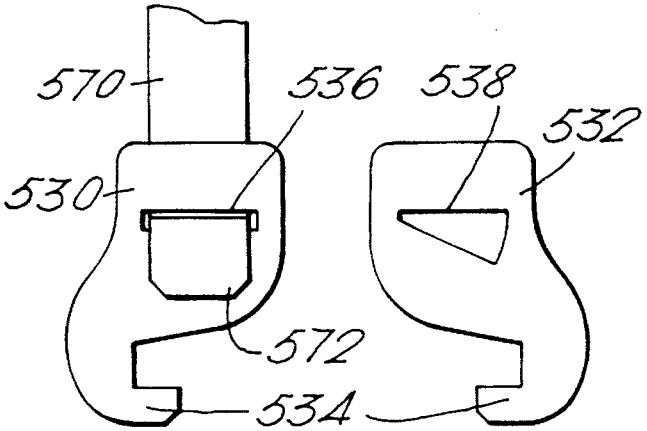
FIG. 26 shows an exploded view of a further embodiment of attachment member.

The attachment device shown in FIG. 25 is made up from two similar halves 400 comprising quarter-circle shape strap portions 402, each of which terminates at one end in an out-turned flange 404, which is apertured so that the flanges can be adjustably secured together by a nut and bolt 405, whereby the two straps portions together form a semi-circular strap to extend around a post 406. The other ends of the straps portions have T-shaped slots 408 to slide over the T-shaped head 412 of a reinforcing member. The strap portions are also provided with spurs 414 which engage the top of the T-shaped head 412, so that each strap portion can be self-supporting on the reinforcing member prior to connecting the flanges 404 together. The strap portions are conveniently cut from a length of extruded aluminium, whereafter holes are formed in the flanges 404 to receive the bolt, and the T-shaped slots 408 are cut in the other ends.

Figure 27:
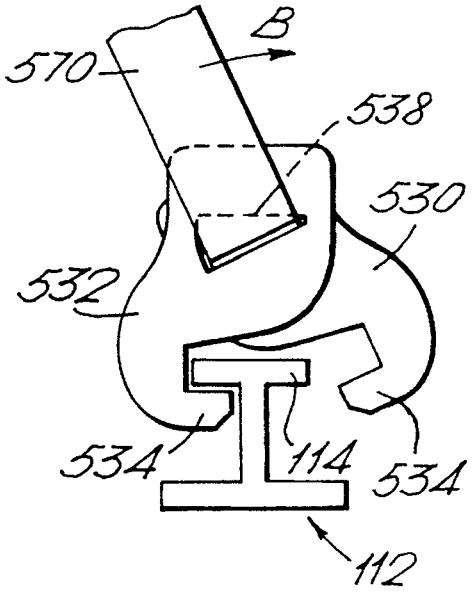
FIGS. 27 and 28 show successive stages in the fitting of the attachment member of FIG. 26 to a reinforcing member.
Figure 28:
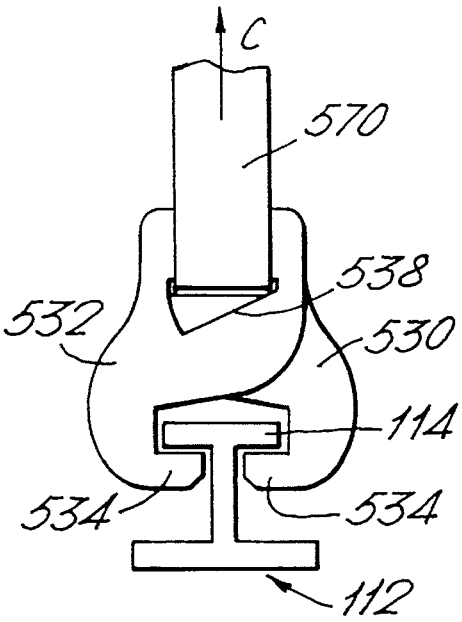
Figure 29:
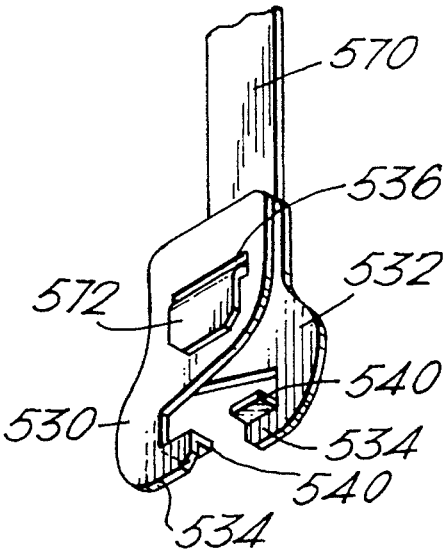
FIG. 29 shows a perspective view of the attachment member of FIGS. 26 to 28.

FIGS. 26–29 show a further embodiment of attachment member, comprising two plates 530, 532 respectively having hook-shaped lower portions 534. The plate 530 has a slot 586 to take the cranked end 572 of the strap 570 as previously described. The plate 532 has a slot 538 of sector-form. The device is assembled by passing the cranked end 572 of the strap 570 through the slot 538 in the plate 532 and then through the slot 536 in the plate 530, as shown in FIG. 29, the shaped ends 534 being mutually inwardly facing, providing thereby a pair of jaws. Conveniently the cranked end 572 is spot-welded to the plate 530, but the plate 532 is in any event loosely held on the strap 570, so that it can pivot to the extent permitted by the sector-shaped slot 538.

This is illustrated in FIGS. 27 and 28, which shows the attachment member in use. Initially the plate 530 is pivoted away from the plate 532, thereby opening the jaws and the jaw of the plate 532 is hooked around the head 114 of the reinforcing member 112. Then, the device is straightened, as indicated by the arrow B in FIG. 27, causing the plate 530 also to hook around the head 114, thereby closing the jaws around the head. This action is reinforced by the tightening of the strap, in the direction shown by the arrow C in FIG. 114, thereby locking the jaws around the head 114.

As shown in FIG. 29, the edges of the jaws 534 which engage under the cross-piece 114 may be provided with turned-over flanges 540, extending in the same or in mutually opposite directions, thereby providing increased bearing surfaces under the head.

What we claim is:

1. An elongate reinforcing member for a sign panel said reinforcing member having a cross-section defining:

(a) a foot portion for securing to a rear face of a sign panel;

(b) a head portion including a dove-tailed slot for engagement with a trapezoidal-shaped head at the end of a strap for passing around a supporting post; and, (c) a leg connecting the head and foot portions, the head portion being offset with respect to the leg, the foot portion being offset in a direction opposite the head portion for rivetting to a sign panel.

2. The reinforcing member according to claim 1 wherein the head portion projects more on a first side of the leg than on a second side of the leg, opposite the first side.

3. The reinforcing member according to claim 2 wherein the foot portion projects more on the second side of the leg.

4. A sign comprising:

(i) a plurality of sign panels abutted edge-to-edge;

(ii) a main, elongate, co-operating, reinforcing member having a cross-section defining a transverse head attached to a mounting device for the sign, and a depending leg terminating in an offset foot portion secured to a rear of a first of said sign panels adjacent an abutting edge of said first panel; and (iii) a second, elongate, co-operating, reinforcing member having a generally L-shaped cross-section comprising a foot portion secured to a rear of a second of said sign panels at an edge abutting the first panel, and an upright portion abutting the leg of the main reinforcing member, wherein a top of the upright portion of the second reinforcing member is offset to engage under the head of the main reinforcing member, one of the reinforcing members having a flange at the foot portion projecting into a recess in the foot portion of the other reinforcing member.

5. The sign according to claim 4 wherein said flange is on the foot portion of the main reinforcing member and the recess is in the foot portion of the second reinforcing member.

6. The sign according to claim 4 wherein the transverse head includes a dove-tailed slot, and the mounting device comprises a strap for passing around a supporting post, the strap having at least one trapezoidal shaped head at an end thereof, the dove-tailed slot being engageable with the trapezoidal shaped head.

* * * * *